US007386255B2

(12) United States Patent
Ochi

(10) Patent No.: US 7,386,255 B2
(45) Date of Patent: Jun. 10, 2008

(54) IMAGE FORMING APPARATUS HAVING A MOVABLE TRANSFER UNIT

(75) Inventor: Junichi Ochi, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 92 days.

(21) Appl. No.: 11/460,571

(22) Filed: Jul. 27, 2006

(65) Prior Publication Data

US 2007/0036585 A1 Feb. 15, 2007

(30) Foreign Application Priority Data

Aug. 11, 2005 (JP) ..... 2005-233288

(51) Int. Cl.
*G03G 15/00* (2006.01)
*G03G 15/16* (2006.01)

(52) U.S. Cl. ..... 399/121; 399/124

(58) Field of Classification Search ..... 399/124, 399/125, 107, 110, 121, 111, 21, 401
See application file for complete search history.

(56) References Cited

U.S. PATENT DOCUMENTS 6,134,404 A * 10/2000 Iwai et al. ..... 399/110
6,973,279 B2 12/2005 Yokoi
7,031,637 B2 4/2006 Fujita
2005/0025544 A1* 2/2005 Yamashita et al. ..... 399/401
2006/0018672 A1* 1/2006 Asaba ..... 399/21
2006/0280533 A1* 12/2006 Ozawa ..... 399/361
2006/0291901 A1* 12/2006 Hiroe et al. ..... 399/121
2007/0110476 A1* 5/2007 Lee et al. ..... 399/121

FOREIGN PATENT DOCUMENTS

JP 2001-002330 A * 1/2001
JP 2003-295562 A 10/2003
JP 2004-287017 A 10/2004
JP 2004-361495 A * 12/2004

* cited by examiner

*Primary Examiner*—Sophia S Chen
(74) *Attorney, Agent, or Firm*—Canon U.S.A. Inc. IP Division

(57) ABSTRACT

A transfer unit is movable between a first position adjacent to an image forming device and a second position for exposing the image forming device, when a door panel is opened. The transfer unit moves to the second position together with the door panel, and when the door panel is in a generally fully opened state, the transfer unit is movable to the first position independently of the door panel, thereby improving the ease of maintenance in the vicinity of the transfer unit.

7 Claims, 7 Drawing Sheets

IMAGE FORMING APPARATUS HAVING A MOVABLE TRANSFER UNIT

BACKGROUND OF THE INVENTION

1. Field of the Invention

The present invention relates to an image forming apparatus such as a copying machine or a laser printer, and in particular relates to an apparatus having a door member and a transfer unit.

2. Description of the Related Art

There has been provided a multi-color image forming apparatus called a tandem type (or an inline type) which typically has a plurality of photosensitive drums placed in a line. This tandem type image forming apparatus mainly includes a transverse configuration in that the photosensitive drums are arranged in a horizontal direction and a longitudinal configuration in that the drums are arranged in a vertical direction. The longitudinal configuration can be reduced in occupied area although the height is increased in comparison with the transverse configuration, so that it has an advantage in usability for jam disposal, for example.

FIG. 8 shows a conventional longitudinal full-color image forming apparatus. Reference numerals 101*a*, 101*b*, 101*c*, and 101*d* denote process cartridges for each color; numeral 102 denotes a transfer unit for transferring image by carrying and conveying a sheet S with a belt 102*a*; and numeral 103 a fuser. Images formed by the process cartridges 101*a*, 101*b*, 101*c*, and 101*d* are transferred on the sheet S carried by the transfer unit 102, and the sheet S carrying the transferred image is discharged out of the apparatus after passing through the fuser 103. When a door 104 is opened, the process cartridges 101*a*, 101*b*, 101*c*, and 101*d* are exposed, facilitating component replacement and jam disposal.

However, in the conventional example mentioned above, when doing maintenance on the backside of the transfer unit 102 (adjacent to the door of the belt 102*a*), the accessibility to this region is difficult because the space between the transfer unit 102 and the door 104 is comparatively small. For example, as shown in FIG. 8, in an apparatus having a sheet conveying unit 105 for double-sided printing arranged on the backside of the transfer unit 102, the space for having access to the sheet conveying unit 105 is very limited. Hence, the disposal of a jam generated in the sheet conveying unit 105 has been very difficult.

SUMMARY OF THE INVENTION

The present invention provides an image forming apparatus capable of improving ease of maintenance in the vicinity of a transfer unit.

According to an aspect of the present invention, an image forming apparatus is provided which includes an image forming unit configured to form an image; a transfer unit configured to transfer the image onto a recording material; and an opening and closing member which is openable and closable with respect to a body portion of the apparatus, wherein the transfer unit is movable between a first position adjacent to the image forming unit and a second position for exposing the image forming unit, wherein when the opening and closing member is being opened, the transfer unit engages with the opening and closing member and moves in a coupled manner with the opening and closing member to the second position, and wherein when the opening and closing member is positioned in a generally fully opened state, the transfer unit becomes disengaged from the opening and closing member and becomes movable to the first position independent of the opening and closing member.

According to another aspect of the present invention, the opening and closing member includes a first engaging portion and the transfer unit includes a second engaging portion configured to engage with the first engaging portion, and wherein when the opening and closing member is being opened, the first and second engaging portions engage with each other, and when the opening and closing member is in the generally fully opened state, the first and second engaging portions become disengaged with each other.

According to yet another aspect of the present invention, the opening and closing member is a part of an exterior cover of the apparatus. And, according to yet another aspect of the present invention, the apparatus further comprising a conveying device provided between the opening and closing member and the transfer unit configured to convey the recording material. Moreover, according to still yet another aspect of the present invention, transfer unit includes a belt configured to carry and convey the recording material. Additionally, according another aspect of the present invention, the transfer unit includes a belt configured to temporarily carry the image before the image is transferred onto the recording material.

Also, according to another aspect of the present invention, an image forming apparatus is provided which includes an image forming unit configured to form an image; a transfer unit configured to transfer the image onto a recording material; and a opening and closing member which is openable and closable with respect to a body portion of the apparatus, wherein the transfer unit is movable between a first position adjacent to the image forming unit and a second position for exposing the image forming unit, wherein the opening and closing member includes a first engaging portion and the transfer unit includes a second engaging portion configured to engage with the first engaging portion, wherein when the opening and closing member is being opened, the first engaging portion engages with the second engaging portion such that the transfer unit moves, coupled with the opening and closing member, to the second position, and wherein the first and second engaging portions change from an engaged state to a disengaged state once the opening and closing member is positioned in a generally fully opened state.

Moreover, according to still another aspect of the present invention, the opening and closing member is rotatable about a first supporting portion and the transfer unit is rotatable about a second supporting.

Further aspects and features of the present invention will become apparent from the following description of exemplary embodiments with reference to the attached drawings.

DESCRIPTION OF THE EMBODIMENTS

Various embodiments, features and aspects of the present invention will be described below with reference to the drawings.

First Exemplary Embodiment

[Exemplary Image Forming Apparatus]

Figure 1:
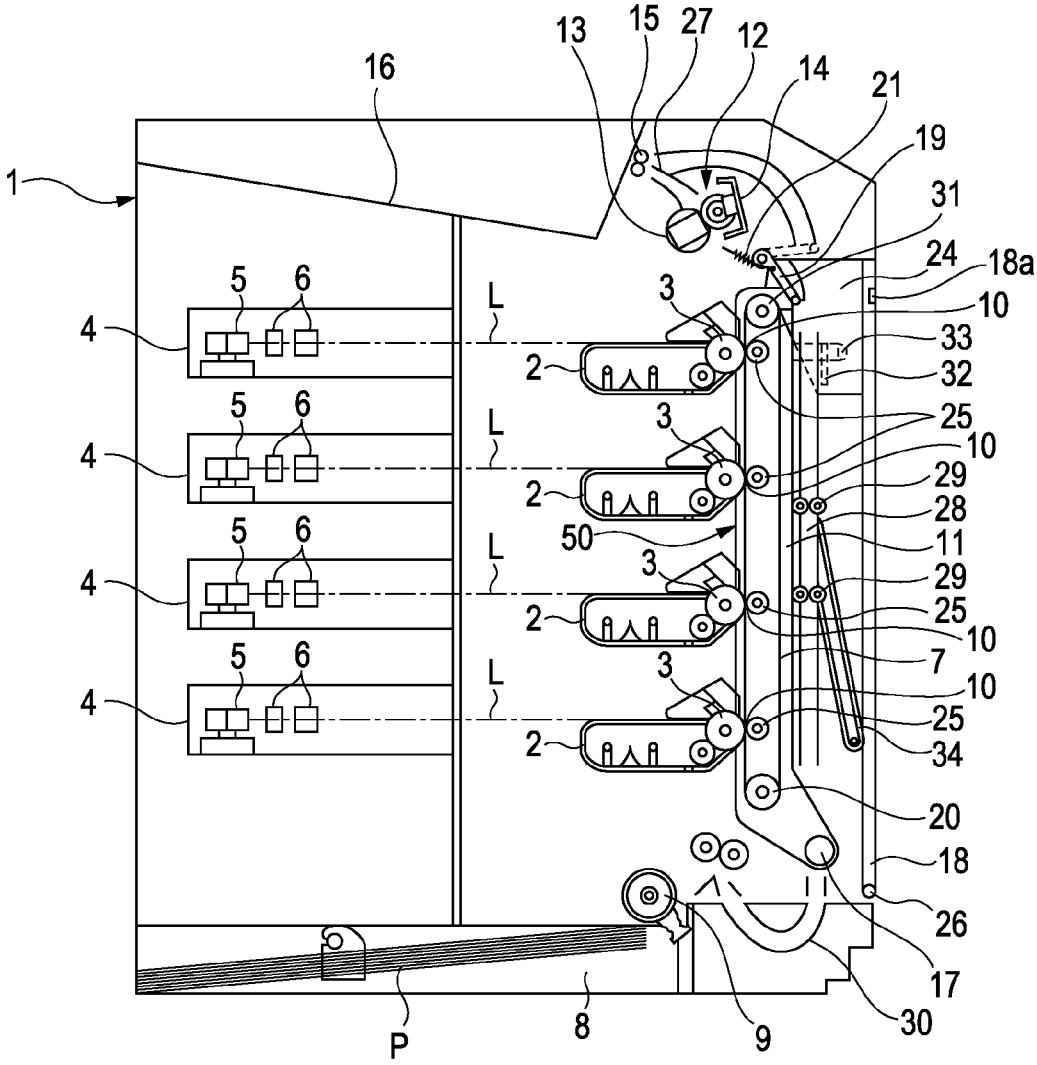
FIG. 1 is an illustration of an exemplary image forming apparatus according to an aspect of the present invention.

FIG. 1 is a sectional view of an exemplary image forming apparatus according to an embodiment of the present invention. The image forming apparatus according to the embodiment uses a color transfer electro-photographic process. This is a tandem-type full-color laser beam printer in that process cartridges of yellow (Y), magenta (M), cyan (C), and black (BK) using non-magnetic mono-component toner and arranged in a line.

An image forming method of the image forming apparatus according to the embodiment will be described below in detail. Process cartridges 2 are detachably arranged in a printer body 1. Each process cartridge 2 according to the embodiment includes a photosensitive drum 3, which is an image bearing member, a charging portion for charging the photosensitive drum 3, a developing unit for developing the image on the photosensitive drum 3, and a cleaning unit for cleaning the residual toner on the photosensitive drum 3. The developing unit also accommodates toner, which is a developer.

The process cartridge 2 has the above-mentioned configuration for each color, so that four process cartridges 2 are provided every one apparatus. As shown in FIG. 1, the four process cartridges 2 are arranged in the vertical direction.

A scanning optical device 4 outputs a laser beam L modulated to correspond to an image information signal sent from a computer connected to the printer body 1 so as to expose the uniformly charged surface of the photosensitive drum 3 and form an electrostatic latent image thereon by scanning the surface. The scanning optical device 4 includes a laser optical system (not shown), a rotating polygon mirror 5 rotated by a motor for scanning the photosensitive drum 3 with a laser beam emitted from the laser optical system, and a lens group 6 for forming a spot of the laser beam. According to the embodiment, by corresponding to a plurality of the photosensitive drums 3, the same number of the scanning optical devices is provided.

Electrostatic latent images formed on the photosensitive drum 3 are developed by a developing device (developer unit) as toner image, and the photosensitive drum 3 bears the toner image. The toner image formed on the photosensitive drum 3 is transferred onto a recording material (transfer material) P so that each color toner image overlap with each other, as will be described in the following. The transfer material (sheet) P placed on a feed cassette 8 are separated one by one by the rotation of a feed roller 9 and conveyed to a transfer section 10. In the transfer section 10, the transfer material P passes through nips formed by the four photosensitive drums for each color and respective transfer rollers 25 opposing thereto so that the toner image for each color are sequentially transferred on the transfer material P so as to overlap with each other.

A transfer unit 50 includes a transfer material conveying belt 7 for conveying a transfer material P, a drive roller 31 and a follower roller 20, which have a belt 7 stretched therebetween, a belt frame 11 for supporting the belt 7, and transfer rollers 25 provided on the backside of the belt 7 corresponding to each color cartridge. The transfer unit 50 is for transferring images formed by the process cartridge 2, which is an image forming device, on the sheet P.

The drive roller 31 obtains a driving force via a drive joint (not shown) provided in the apparatus body. The transfer unit 50 is rotatable about a second supporting portion 17 which is belt-frame hinge provided in the vicinity of the lower end as a rotational support so that the transfer unit 50 is rotationally held to the apparatus body. Although details will be described later, the transfer unit 50 is movable between an adjacent position (first position) adjacent to the process cartridge 2 and an opening position (second position) for exposing the process cartridge 2. When the transfer unit 50 is located at the first position, the vicinity of the upper end of the belt frame 11 is held by a holding lever 19 and the transfer unit 50 is accurately positioned to have a closed position covering the process cartridge 2. The holding lever 19 applies a force from a tensile spring 21, and by throwing up the holding lever 19, the holding force applied to the belt frame 11 by the holding lever 19 can be released. According to the embodiment, the two holding levers 19 are provided, so that upper-end lateral sides of the belt frame 11 (in a direction perpendicular to the belt moving direction, i.e., axial direction of the drive roller 31) are respectively pressurized. Further it is noted that the two holding levers 19 are connected together with via a connection shaft (not shown) so as to move both holding levers 19 together. Hence, when one of the two holding levers 19 is operated or moved, the other moves in the same way.

A door panel (an opening and closing member) 18 is a part of an exterior panel (exterior cover) and is provided outside of the transfer unit 50. The door panel 18 is an door panel which is openable and closable with respect to a main body of the image forming apparatus. The door panel is rotatable about a first supporting portion 26 different from the second supporting portion. A door hinge (a first supporting portion) 26 is arranged in the vicinity of its lower end as a rotational support so that the door panel 18 is foldably held to the apparatus body so as to rotate about the apparatus body. The door panel 18 is provided with a releasing member 24 for releasing the holding force of the holding lever 19, the operation of which will be described later in detail. The door panel 18 is opened by a handle 18*a*.

The transfer material P going out of the transfer section 10 is conveyed to a thermal fuser 12. In the thermal fuser 12, the transfer material P carrying unfixed toner image therewith is passed through a fixing nip formed of a heating device 13 having a heater built in and a pressurizing device 14 so as to heat and fix the toner image.

During one-sided printing, the transfer material P finished the fixing is discharged on a discharge stacker 16 by a discharge roller pair 15. During double-sided printing, the transfer material P finished the fixing passes along a conveying path, which is switched by the reverse rotation of the discharge roller pair 15 directly before the trailing end of the transfer material P reaches the discharge roller pair 15, so as to be fed to a double-sided conveying path 28. The double-sided conveying path 28 is arranged on the backside of the transfer unit 50, including guide ribs and guide rollers (not shown) arranged inside the door panel 18. That is, the double-sided conveying path 28 for conveying the transfer material P is arranged between the transfer unit 50 and the door panel 18. The double-sided conveying path 28 is provided with a diagonal-feed roller pair 29 arranged for conveying the transfer material P as well as positioning the transfer material P in the lateral direction by allowing side edges of the transfer material P to pass along a guide member (not shown). The transfer material P having passed through a lowest U-turn path 30 is again fed to the transfer section 10 and printed on the other side.

[Exemplary Replacement of Process Cartridge and Jam Disposal]

Next, details about the replacement of the process cartridge and the jam disposal of transfer material, will be described with reference to FIGS. 2A to 4.

The process cartridge 2 according to the embodiment described above, as discussed includes a charging device (charger), a developing device (developer unit) having a developer carrier and a developer container for accommodating toner to be conveyed to the developer carrier, and a cleaning device (cleaner unit), which are integrally consolidated to have a cartridge. The process cartridge 2 is detachably mounted on the apparatus body for forming an image so as to be replaceable by a user oneself when toner is consumed or the image bearing member needs to be replaced. The process cartridge 2 is mounted at a predetermined position along a rail-like member (not shown) provided inside the apparatus body. According to the embodiment, the image-forming apparatus is of a tandem type, so that a plurality of the process cartridges 2 are linearly arranged, as mentioned above.

Figure 2A:
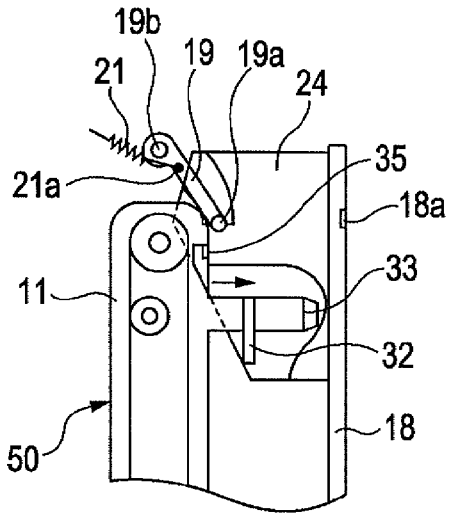
FIGS. 2A to 2C are illustrations of the vicinity of an exemplary engaging portion between an door panel and a transfer unit according to an aspect of the present invention.
Figure 2B:
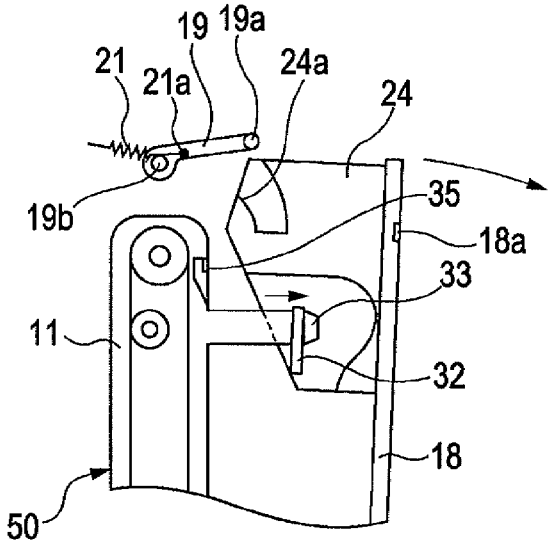

When a user replaces the process cartridge 2 or disposes of a paper jam, the door panel 18 at the front of the apparatus is first opened. At this time, as shown in FIGS. 2A and 2B, when the door panel 18 is slightly opened, the releasing member 24 also moves together with the door panel 18. Then, a projection 19*a* of the holding lever 19 slides on an inclined surface 24*a* of the releasing member 24 so as to be raised upwardly. As a force of the spring 21 is applied to a position above the rotational fulcrum (rotational center) 19*b* of the holding lever 19, the holding lever 19 is maintained in a released state by the spring 21.

According to the embodiment, with respect to the holding lever 19, since the distance between the projection 19*a* and the rotational fulcrum 19*b* is larger than that between a portion 21*a* of the spring 21 applying force to the holding lever 19 and the rotational fulcrum 19*b*, the door panel 18 can be opened with a comparatively small force. As previously mentioned, the two holding levers 19 are connected together with the connection shaft (not shown), so that even when a user pulls any one of the holding levers 19, the holding force due to both holding levers 19 is simultaneously released, preventing the mechanism from being damaged in advance.

Further, it is noted that a driving joint for transmitting a rotational force to the drive roller 31 of the transfer unit 50 is separated simultaneously with the release of the holding lever 19.

In the releasing stage, an engagement claw 32 mounted on the door panel 18, which is a first engaging portion, and an engagement claw 33 mounted on the belt frame 11, which is a second engaging portion, are spaced at a predetermined interval. Hence, in the transfer unit 50 left in place of the apparatus body, the belt frame 11 can be released by slightly opening the door panel 18.

Figure 3:
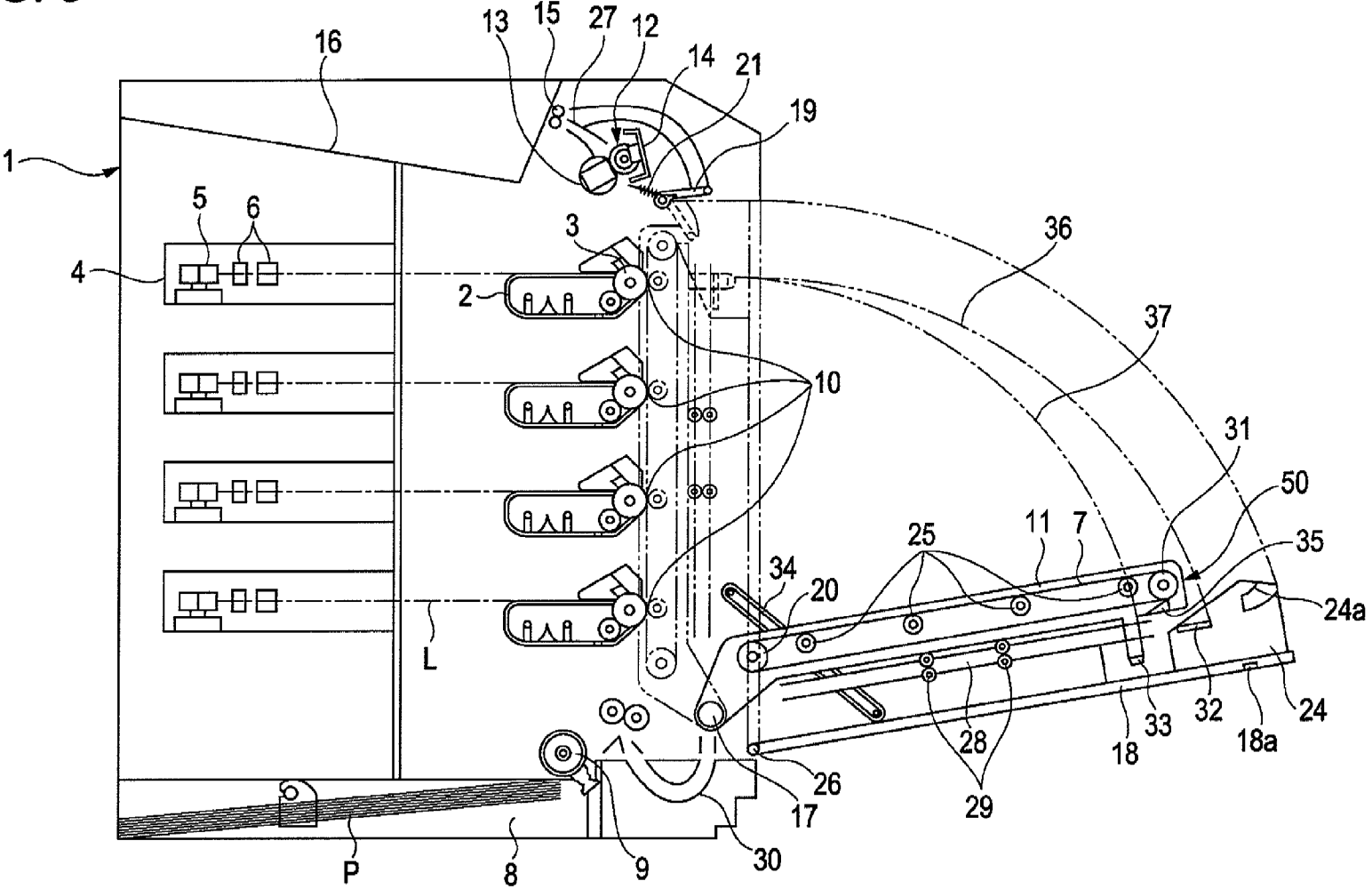
FIG. 3 is an illustration showing the door panel and the transfer unit in an opened state according to an aspect of the present invention.

Then, after the door panel 18 is opened by a predetermined amount so as to release the belt frame 11, the transfer unit 50 is simultaneously opened with the opening of the door panel 18 by the engagement between the engagement claws 32 and 33. That is, as shown in FIG. 3, when the door panel 18 is opened, the transfer unit 50 moves along with the door panel 18 so as to be moved to an opened position. The opening angle of the door panel 18 is finally limited by a stopper 34.

In such a manner, according to the embodiment, by only one action that is pulling the door panel 18 to open, a user can replace the process cartridge 2 and dispose paper jam in the image-forming section.

[Exemplary Paper Jam Disposal On Backside Of Transfer Unit]

Next, the paper jam disposal on the backside (adjacent to the door panel 18) of the transfer unit 50 and in the double-sided conveying path 28 will be described.

Figure 2C:
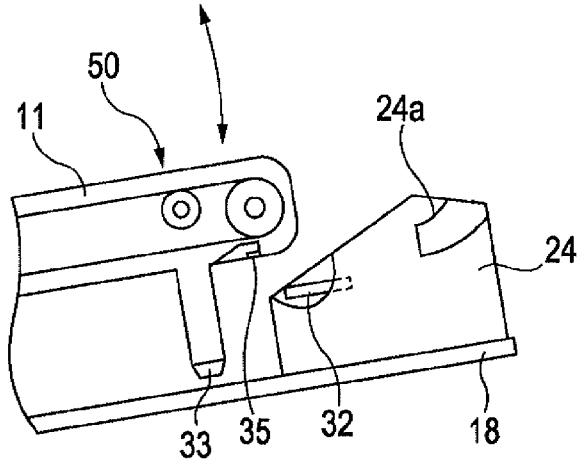

As shown in FIG. 1, the door panel 18 and the transfer unit 50 include rotational supports (the belt frame hinge 17, the door hinge 26) at respective different positions. Hence, the trajectories of the engagement claws 32 and 33 when they are opened are different phantom lines 36 and 37 shown in FIG. 3. Thus, when the opening angle of the door panel 18 becomes large, as shown in FIG. 2C, the engagement claw 32 is brought into disengagement with the engagement claw 33. The first engaging portion 32 and the second engaging portion 33 change from an engaged state to a disengaged state according to an opening operation of the door panel 18.

That is, the door panel 18 and the transfer unit 50 include the engagement claws 32 and 33, respectively, which can engage with each other. When the door panel 18 is opened, the engagement claws 32 and 33 are engaged with each other. When the door panel 18 is in an opened state, the engagement claws 32 and 33 are in a disengaged state. In this opened state of the door panel 18, the transfer unit 50 can be moved to the first position independently of the door panel 18.

The opening angle to have the disengaged state is designed to open to the position of the full-opened state due to the self-weight of the transfer unit 50, so that even after the engagement is released, the transfer unit 50 continues to be opened together with the door panel 18. Alternatively, a spring may be used instead of the self-weight, however, the position where the engagement is released must be a position where the transfer unit 50 is independently opened. That is, after the door panel 18 is once opened completely, the engagement claws 32 and 33 are in the disengaged state, so that the transfer unit 50 is established to independently open/close until to the position at the maximum opening angle, where comes in contact with the door panel 18. Thereby, in the opened state of the door panel 18, the transfer unit 50 is movable to a position adjacent to the process cartridge 2, independently of the door panel 18.

Figure 4:
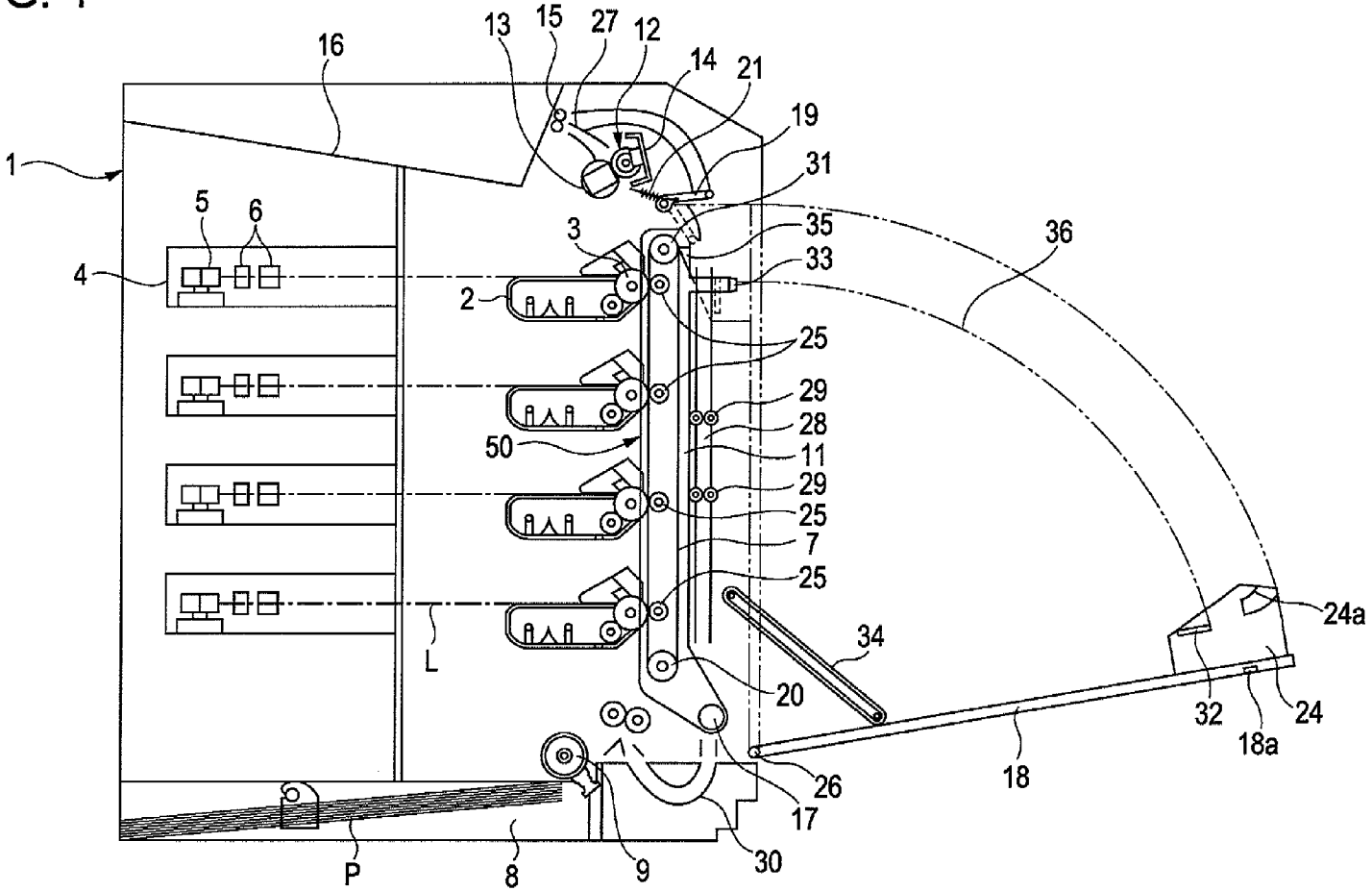
FIG. 4 is an illustration showing the opened door panel and the closed transfer unit according to an aspect of the present invention.

The belt frame 11 is provided with a handgrip 35 molded with a color simply recognizable by a user. When a user, as shown in FIG. 4, independently closes the transfer unit 50 from the state of the apparatus shown in FIG. 3 using the handgrip 35, the backside of the transfer unit 50 and the double-sided conveying path 28 arranged on the backside of the transfer unit 50 appear, so that the maintenance on the backside of the transfer unit 50 and the jam disposal in the double-sided conveying path 28 are facilitated.

That is, in the opened state of the door panel 18, the engaging between the door panel 18 and the transfer unit 50 is released, so that the transfer unit 50 can be independently closed, facilitating the jam disposal on the backside of the transfer unit 50 and the paper transfer path between the transfer unit 50 and the door panel 18.

Figure 5:
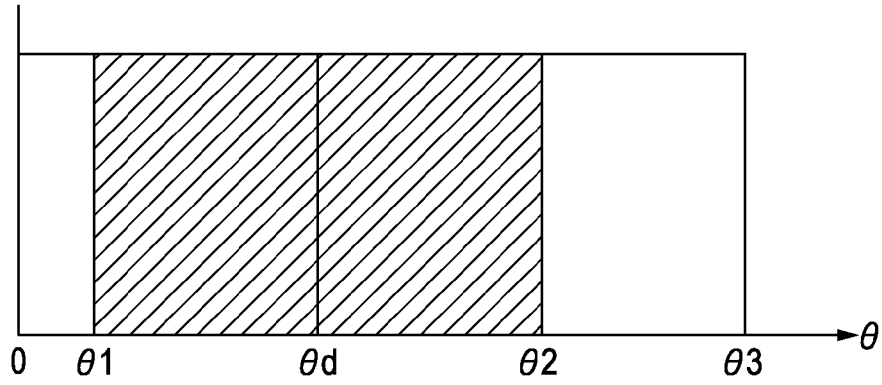
FIG. 5 is a plot showing the open angle and the engaging state of the door panel according to an aspect of the present invention.

The above-mentioned setting method of the transition position from the engaged state to the disengaged state of the engagement claws 32 and 33 will be described with reference to FIG. 5 more in detail. FIG. 5 illustrates the relationship between the opening angle of the door panel 18 and the engaging state of transfer unit 50 for easier understanding, in which the opening angle θ is plotted in abscissa and the shaded area shows the engaging region between the transfer unit 50 and the door panel 18. That is, θ=0 is the apparatus operating state (the closed position of the door panel 18); θ1 is the engagement initiating angle; θ2 is the engagement releasing angle (i.e., the transition angle from the engaged state to the disengaged state); and θ3 shows the full-opened state of the door panel 18.

Accordingly, in other words:

(1) 0<θ<θ1 is an interval in that the belt frame 11 is released in a disengaged state when the door panel 18 is opened;

(2) θ1<θ<θ2 is an interval in that the door panel 18 and the transfer unit 50 integrally open/close in an engageable state; and (3) θ2<θ<θ3 is an interval in that the transfer unit 50 is openable/closable independently in a disengaged state.

In the drawing, θd indicates the neutral state of the transfer unit 50. The neutral state means a balanced state between a closing force and an opening force by gravity. That is, the condition determining θ2 is that θd<θ2<θ3 as well as the engagement claws 32 and 33 are not interrupted with each other at the position θ3.

After the jam disposal in the double-sided conveying path 28, i.e., in a state that only the transfer unit 50 is closed in advance, the door panel 18 can be closed thereafter. This operation will be described below in detail.

Figure 6:
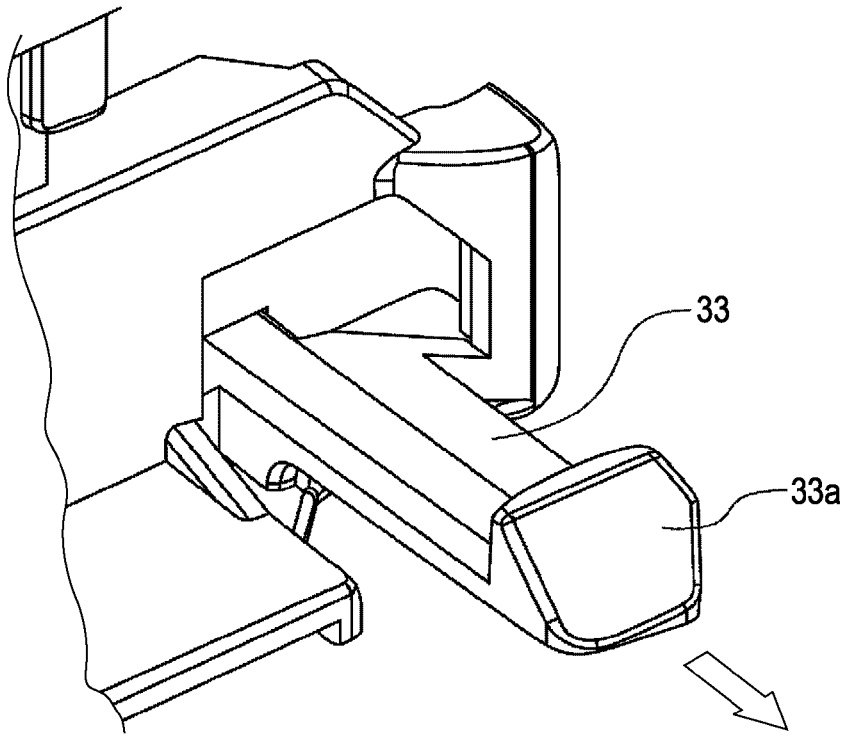
FIG. 6 is a perspective drawing showing the engaging portion according to an aspect of the present invention.

The engagement claw 33 attached to the belt frame 11 is molded of a resin material in a shape shown in FIG. 6, so that it can be deflected by an external force in arrow direction of FIG. 6. A contact surface 33*a* is chamfered. When the door panel 18 is pushed by applying an external force thereto, the engagement claw 32 attached to the door panel 18 comes in contact with the contact surface 33*a* of the engagement claw 33 so as to pass through an interrupting position by deflecting the engagement claw 33, so that the door panel 18 can be closed.

When the door panel 18 is closed from an opened state of both the transfer unit 50 and the door panel 18, the transfer unit 50 and the door panel 18 can be closed together without any problem since it is the reverse operation to the opening. During closing the door panel 18, the belt frame 11 is returned to the positioning state, and the drive joint is simultaneously bound for transmitting the rotational force to the drive roller 31.

In such a manner, according to the embodiment, during the replacement of the process cartridge and the jam disposal in the image-forming section, by only one action that is opening the door panel 18, a user can engage these works, bringing a marked improvement in operability.

In the maintenance on the backside of the transfer unit, such as the jam disposal in the double-sided conveying path 28, after the door panel 18 is opened, the transfer unit 50 can be independently closed, so that a user can do the maintenance by opening the space between the transfer unit 50 and the door panel 18.

In an opened state of the door panel 18, the engagement between the door panel 18 and the transfer unit 50 is released, so that the transfer unit 50 can be fairly closed independently without a specific work to release the engagement after the door member is opened, improving ease of maintenance between the transfer unit 50 and the door panel 18.

In order to open the space between the transfer unit 50 and the door panel 18, two actions of opening the door panel 18 and closing the transfer unit 50 thereafter are needed; however, the replacement of the process cartridge or the jam disposal in the image-forming section is generally more frequent in comparison with the jam disposal in the double-sided conveying path 28. Hence, according to the embodiment, the load to a user can be largely reduced.

Incidentally, in many laser beam printers presently circulating on the market, which are mainly monochrome laser beam printers, when the door panel is opened, the process cartridge is accessible, so that former users may not be disturbed because of the same operational system.

In such a manner, according to the embodiment, the door panel and the transfer unit can be opened by one action so as to facilitate the replacement of the process cartridge or the jam disposal. Since the backside of the transfer unit can be also opened, the maintenance on the backside of the transfer unit and the jam disposal in the double-sided conveying path can be easily performed, so that the user-friendly apparatus can be provided.

The transfer unit does not necessarily require the belt as long as the transfer material can be conveyed with transfer rollers, so that a belt-less transfer unit may be used.

Second Exemplary Embodiment

Figure 7:
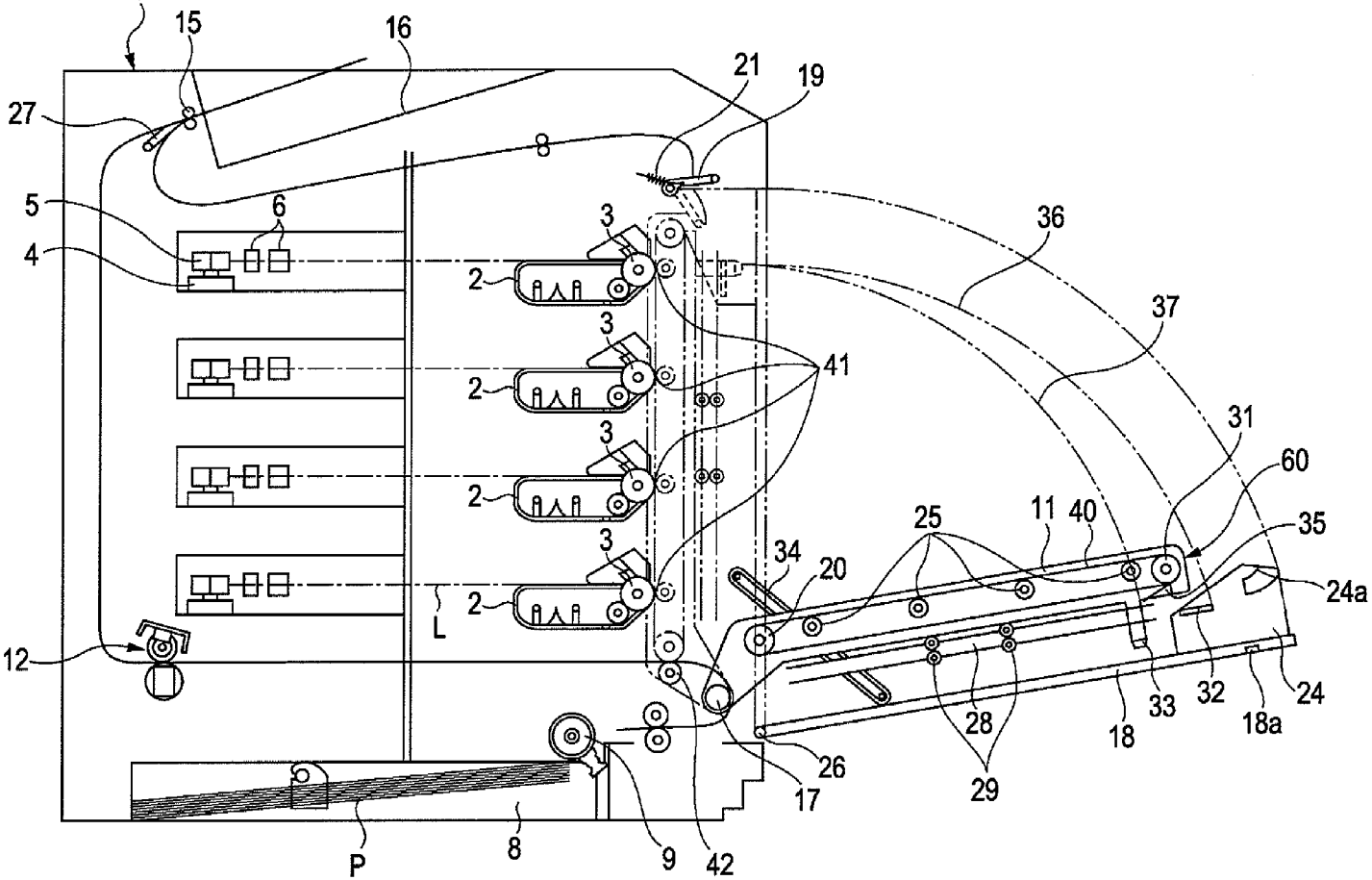
FIG. 7 is an illustration of an image forming apparatus according to another embodiment of the present invention.
Figure 8:
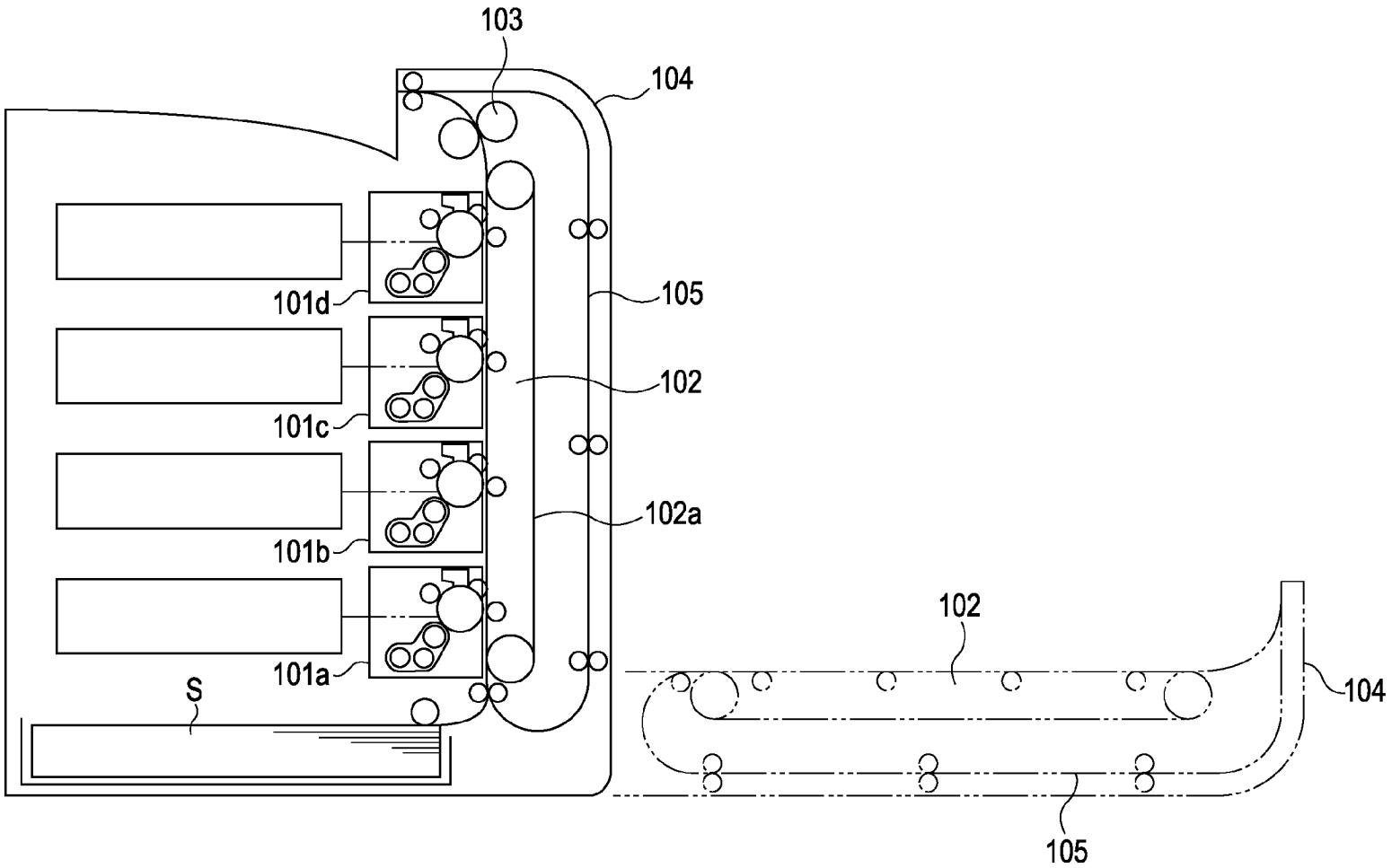
FIG. 8 PRIOR ART
FIG. 8 is an illustration of a conventional image forming apparatus.

An illustration of an exemplary image-forming apparatus according to a second embodiment is shown in FIG. 7. The image-forming apparatus according to the embodiment, in the same way as in the first embodiment, is a color laser beam printer having four process cartridges using non-magnetic mono-component toner and an electro-photographic process.

[Exemplary Image-Forming Apparatus]

The configuration specific to the present embodiment will be described below. It is noted that like reference characters designate like components common to the first embodiment, and the description of the components with the same structure is omitted.

In the apparatus according to the embodiment, an intermediate transfer belt 40 is arranged so as to oppose the photosensitive drums 3 of the linearly arranged process cartridges 2. The toner image formed on the photosensitive drums 3 is sequentially transferred on the intermediate transfer belt 40 at primary transfer parts 41 so as to overlap each color toner image. The four-color toner images formed on the intermediate transfer belt 40 are secondarily transferred collectively at a secondary transfer part 42 on the transfer material P conveyed from a paper feed section.

That is, a transfer unit 60 includes the intermediate transfer belt 40 for temporarily carrying the image formed by the process cartridges 2 before the image is transferred on the transfer material. Then, the transfer material P carrying unfixed toner image therewith is thermally fixed in the thermal fuser 12. During one-sided printing, the transfer material P is discharged on the discharge stacker 16 by the discharge roller pair 15. During double-sided printing, the discharge roller pair 15 is reversely rotated so as to switch a conveying path with a flapper 27, so that the transfer material P is conveyed to the double-sided conveying path 28. Also, the intermediate transfer belt 40 is stretched between the drive roller 31 and the follower roller 20, and attached to the belt frame 11.

According to the embodiment, the intermediate transfer belt 40, the transfer rollers 25, the drive roller 31, the follower roller 20, and the belt frame 11 constitute components of the transfer unit 60. The belt frame 11 includes the belt-frame hinge 17 provided in the vicinity of the lower end as a rotational support so that the transfer unit 60 is rotationally held to the apparatus body.

The belt frame 11 includes the door panel 18 arranged on its outside for forming part of an exterior panel. The door panel 18 includes the door hinge 26 arranged in the vicinity of its lower end as a rotational support so that the door panel 18 is foldably held to the apparatus body so as to rotate about the apparatus body.

In a similar way as in the first embodiment, the door panel 18 and the belt frame 11 include the engagement claws 32 and 33 mounted thereto, respectively. Also, in a similar way as in the first embodiment, according to the embodiment, by only one action that is pulling the door panel 18, a user can also replace the process cartridge 2, bringing a marked improvement in operability. Also, the jam disposal in the double-sided conveying path can be executed by actions of opening the door panel 18 and closing the transfer unit 60 thereafter.

The jam frequency is reduced because of the improvement in performance of the laser beam printer, so that the replacement frequency of the four-color process cartridges may be relatively increased. Hence, the process cartridge with higher incidence of access can be accessed by one action so as to largely reduce the load to a user.

In such a manner, according to the embodiment, by opening the door panel and the transfer unit with one action, the replacement of the process cartridge and the jam disposal are also facilitated. Since the backside of the transfer unit can be also opened, the maintenance on the backside of the transfer unit and the jam disposal in the double-sided conveying path can be easily performed, so that the user-friendly apparatus can be provided.

According to the embodiments described above, the four process cartridges are vertically arranged in a line; however, the present invention is not limited to this configuration, so that the process cartridges may also be diagonally arranged.

Other Exemplary Embodiments

Additionally, it is noted that the number of the scanning optical devices or the rotating polygon mirrors is not necessarily equal to that of the photosensitive drums as long as the number of finally emitted laser beams corresponds to the respective photosensitive drums. Further, the scanning optical device may also be an exposing unit such as an LED array.

Moreover, the drive device for driving the belt may also be a motor arranged on the belt frame. Also, the process cartridge may include a photosensitive drum and at least one image forming device acting upon the drum.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-233288 filed Aug. 11, 2005, which is hereby incorporated by reference herein in its entirety.

What is claimed is:

1. An image forming apparatus comprising:

an image forming unit configured to form an image;

a transfer unit configured to transfer the image onto a recording material; and an opening and closing member which is openable and closable with respect to a body portion of the apparatus, wherein the transfer unit is movable between a first position adjacent to the image forming unit and a second position for exposing the image forming unit, wherein when the opening and closing member is being opened, the transfer unit engages with the opening and closing member and moves in a coupled manner with the opening and closing member to the second position, wherein when the opening and closing member is positioned in a generally fully opened state, the transfer unit becomes disengaged from the opening and closing member and becomes movable to the first position independent of the opening and closing member, wherein the opening and closing member includes a first engaging portion and the transfer unit includes a second engaging portion configured to engage with the first engaging portion, and wherein when the opening and closing member is being opened, the first and second engaging portions engage with each other, and when the opening and closing member is in the generally fully opened state, the first and second engaging portions become disengaged with each other.

2. An image forming apparatus comprising:

an image forming unit configured to form an image;

a transfer unit configured to transfer the image onto a recording material; and an opening and closing member which is openable and closable with respect to a body portion of the apparatus, wherein the transfer unit is movable between a first position adjacent to the image forming unit and a second position for exposing the image forming unit, wherein the opening and closing member includes a first engaging portion and the transfer unit includes a second engaging portion configured to engage with the first engaging portion, wherein when the opening and closing member is being opened, the first engaging portion engages with the second engaging portion such that the transfer unit moves, coupled with the opening and closing member, to the second position, and wherein the first and second engaging portions change from an engaged state to a disengaged state once the opening and closing member is positioned in a generally fully opened state.

3. The apparatus according to claim 2, wherein the opening and closing member is rotatable about a first supporting portion and the transfer unit is rotatable about a second supporting portion.

4. The apparatus according to claim 2, wherein the opening and closing member is a part of an exterior cover of the apparatus.

5. The apparatus according to claim 2, further comprising a conveying device provided between the opening and closing member and the transfer unit for conveying the recording material.

6. The apparatus according to claim 2, wherein the transfer unit includes a belt configured to carry and convey the recording material.

7. The apparatus according to claim 2, wherein the transfer unit includes a belt for temporarily carrying the image before the image is transferred onto the recording material.

* * * * *